US012372276B2

(12) United States Patent
Shanmugam et al.

(10) Patent No.: US 12,372,276 B2
(45) Date of Patent: Jul. 29, 2025

(54) OIL MANAGEMENT IN REFRIGERATION SYSTEMS

(71) Applicant: Hill Phoenix, Inc., Conyers, GA (US)

(72) Inventors: Senthilkumar Kandappa Goundar Shanmugam, Covington, GA (US); Jeffrey E. Newel, Snellville, GA (US); Manu Mital, Covington, GA (US); John Vincent Mullis, Newnan, GA (US); Sean Taylor, Eatonton, GA (US); Grady L. Calcote, Lawrenceville, GA (US)

(73) Assignee: Hill Phoenix, Inc., Conyers, GA (US)

( * ) Notice: Subject to any disclaimer, the term of this patent is extended or adjusted under 35 U.S.C. 154(b) by 38 days.

(21) Appl. No.: 17/467,630

(22) Filed: Sep. 7, 2021

(65) Prior Publication Data

US 2023/0076487 A1 Mar. 9, 2023

(51) Int. Cl.

| | |
|---|---|
| ***F25B 31/00*** | (2006.01) |
| ***F25B 9/00*** | (2006.01) |
| ***F25B 41/40*** | (2021.01) |

(52) U.S. Cl.

CPC ..... *F25B 31/004* (2013.01); *F25B 9/008* (2013.01); *F25B 41/40* (2021.01)

(58) Field of Classification Search

CPC ..... F25B 31/004; F25B 31/002; F25B 41/40; F25B 9/008; F25B 43/006;

(Continued)

(56) References Cited

U.S. PATENT DOCUMENTS 3,955,375 A * 5/1976 Schumacher ..... F25B 43/006 62/503
4,979,371 A * 12/1990 Larson ..... F25B 47/022 62/81

(Continued)

FOREIGN PATENT DOCUMENTS

| | | |
|---|---|---|
| EP | 3572741 | 11/2019 |
| WO | WO 2006/091190 | 8/2006 |
| WO | WO 2012/176072 | 12/2012 |

OTHER PUBLICATIONS

"riser." Collins English Dictionary, edited by Collins Dictionaries, 12th edition, 2014. Credo Reference, https://search.credoreference.com/content/entry/hcengdict/riser/0?institutionId=743. Accessed Jul. 24, 2023.*

(Continued)

*Primary Examiner* — Tavia Sullens
(74) *Attorney, Agent, or Firm* — Fish & Richardson P.C.

(57) ABSTRACT

A refrigeration assembly includes a receiver tank, a heat exchanger, a first piping assembly, and a second piping assembly. The receiver tank has a fluid outlet and a fluid inlet that receives a working fluid. The heat exchanger is disposed within the receiver tank. The heat exchanger has coiled tubing that is fluidly coupled to the fluid inlet and to the fluid outlet. The first piping assembly is disposed between and is fluidly coupled to the fluid inlet and the coiled tubing. The first piping assembly has a first double riser and a first P-trap. The second piping assembly is disposed between and is fluidly coupled to the fluid outlet and the coiled tubing. The second piping assembly includes a second double riser and a second P-trap.

20 Claims, 7 Drawing Sheets

(58) Field of Classification Search
CPC ..... F25B 2400/051; F25B 2400/23; F25B 2700/2109; F25B 2313/001
See application file for complete search history.

(56) References Cited

U.S. PATENT DOCUMENTS 6,681,597 B1 * 1/2004 Yin ..... F25B 43/006 62/503
2007/0163296 A1 * 7/2007 Suzuki ..... F25B 43/006 62/512

OTHER PUBLICATIONS

International Search Report and Written Opinion in International Appln. No. PCT/US2022/076069, dated Dec. 5, 2022, 11 pages.

* cited by examiner

OIL MANAGEMENT IN REFRIGERATION SYSTEMS

FIELD OF THE DISCLOSURE

This disclosure relates to refrigeration systems, and particularly to oil management in refrigeration systems.

BACKGROUND OF THE DISCLOSURE

Refrigeration systems are used to cool spaces such as refrigerators, display cases, coolers, and freezers. Refrigeration systems rely on refrigeration cycles of a refrigerant that alternately absorbs and rejects heat as the refrigerant is circulated through the system. Refrigeration systems include one or more compressors that compress the working fluid to increase the pressure of the fluid as part of the refrigeration cycle. Compressors may use oil for different purposes, such as to lubricate components of the compressor. The oil can mix with the working fluid and leave the compressor, which can affect the operation of the compressor and reduce the heat transfer and energy efficiency of the working fluid. The refrigeration system can use different piping configurations to return the oil to the compressor. Methods and equipment for returning the oil to the compressor are sought.

SUMMARY

Implementations of the present disclosure include a refrigeration assembly that includes a receiver tank, a heat exchanger, a first piping assembly, and a second piping assembly. The receiver tank has a fluid outlet and a fluid inlet that receives a working fluid. The heat exchanger is disposed within the receiver tank. The heat exchanger has coiled tubing that is fluidly coupled to the fluid inlet and to the fluid outlet. The first piping assembly is disposed between and is fluidly coupled to the fluid inlet and the coiled tubing. The first piping assembly has a first double riser and a first P-trap. The second piping assembly is disposed between and is fluidly coupled to the fluid outlet and the coiled tubing. The second piping assembly includes a second double riser and a second P-trap.

In some implementations, the working fluid includes a mixture of refrigerant and oil, and the first P-trap and the second P-trap are configured to retain oil accumulated during flowing of the refrigerant through the refrigeration assembly. In some implementations, each of the first piping assembly and the second piping assembly flow, during different load conditions of the refrigeration assembly, the oil from the respective P-traps toward the fluid outlet of the heat exchanger coil. In some implementations, the coiled tubing has a first end attached to the first double riser and a second end attached to the second double riser. The first end resides at a first elevation and the second end resides at a second elevation lower than the first elevation.

In some implementations, the first double riser flows oil received from the first P-trap to the coiled tubing. The second P-trap receives oil from the coiled tubing. The second double riser flows oil received from the second P-trap to the fluid outlet of the heat exchanger coil.

In some implementations, the refrigeration assembly operates under a first load condition and a second load condition higher than the first load condition. The first riser of the first double riser increase a flow speed of the working fluid when the first P-trap is substantially blocked by accumulated oil during the first load condition. A second riser of the second double riser increases a flow speed of the working fluid when the second P-trap is substantially blocked by accumulated oil during the first load condition.

In some implementations, the first P-trap retains oil received from the fluid inlet during a low-load condition of the refrigeration assembly, and the second P-trap retains oil received from the coiled tubing during the low-load condition of the refrigeration assembly.

In some implementations, the fluid inlet is fluidly coupled to a supply suction line that has a first diameter. The fluid outlet is fluidly coupled to a return suction line that has a second diameter substantially equal to the first diameter.

In some implementations, the first double riser and the second double riser each have a first riser that has a first diameter and a second riser that has a second diameter larger than the first diameter. The second riser has the respective P-trap, and each of the first riser and second riser are attached to the respective fluid outlet or fluid inlet of the heat exchanger coil.

In some implementations, the receiver tank includes a flash tank of a $CO_2$ refrigeration assembly. The heat exchanger coil flows $CO_2$ as refrigerant. The receiver tank retains a liquid phase of the $CO_2$ refrigerant in thermal contact with the heat exchanger coil. The fluid inlet of the flash tank receives $CO_2$ refrigerant from one or more evaporators, and the fluid outlet routes the $CO_2$ refrigerant to one or more compressors.

In some implementations, the first piping assembly and the second piping assembly are in thermal contact with the fluid inside the receiver tank such that the working fluid flowing through the first piping assembly and the second piping assembly transfers heat to the liquid inside the receiver tank or the liquid inside the receiver tank transfers heat to the first piping assembly and the second piping assembly.

Implementations of the present disclosure include a refrigeration assembly that includes a receiver tank and a heat exchanger. The receiver tank defines a volume that retains a liquid. The heat exchanger is disposed within the receiver tank and is in thermal contact with the liquid. The heat exchanger directs a working fluid there through and transfers heat from the working fluid to the liquid or vice versa. The heat exchanger includes coiled tubing, a fluid inlet, a piping assembly, and a fluid outlet. The fluid inlet is fluidly coupled to the coiled tubing and is configured to receive the working fluid. The piping assembly is disposed between and is fluidly coupled to the fluid inlet and the coiled tubing. The piping assembly has a riser and an oil trap. The fluid outlet is fluidly coupled to the coiled tubing. The fluid outlet directs the working fluid received from coiled tubing out of the receiver tank.

In some implementations, the riser includes a second coiled tubing in thermal communication with the liquid inside the flash tank. The second coiled tubing is disposed between the fluid inlet and the fluid outlet of the heat exchanger.

In some implementations, the oil trap is disposed downstream of the riser and resides between the riser and the coiled tubing.

In some implementations, the riser is attached, at a fluid connection, to a pipe connected to the outlet. The fluid connection is disposed between the fluid outlet and the coiled tubing.

In some implementations, the working fluid includes a mixture of refrigerant and oil. The oil trap retains oil accumulated during flowing of the refrigerant through the heat exchanger. The piping assembly directs, during different load conditions of the refrigeration assembly, the oil from the oil trap toward the fluid outlet of the heat exchanger. In some implementations, the coiled tubing includes a first end attached to the fluid outlet and a second end attached to the fluid inlet. The first end resides at a first elevation and the second end resides at a second elevation lower than the first elevation. The riser flows oil received from the oil trap to the fluid outlet of the heat exchanger.

In some implementations, the refrigeration assembly includes a second piping assembly attached to and residing between the coiled tubing and the fluid outlet. The first piping assembly is attached to and residing between the coiled tubing and the fluid inlet. The first piping assembly includes a second riser attached to the oil trap, and the second piping assembly including a second oil trap, a third riser, and a fourth riser attached to the oil trap.

In some implementations, the refrigeration assembly operates under a first load condition and a second load condition higher than the first load condition. The first riser increases a flow speed of the working fluid with the first P-trap substantially blocked by accumulated oil during the first load condition. The second riser increases a flow speed of the working fluid with the second P-trap substantially blocked by accumulated oil during the first load condition.

In some implementations, the fluid inlet is fluidly coupled to a supply suction line that has a first diameter. The fluid outlet is fluidly coupled to a return suction line that has a second diameter substantially equal to the first diameter.

Particular implementations of the subject matter described in this specification can be implemented so as to realize one or more of the following advantages. For example, the refrigeration assembly of the present disclosure can increase the heat transfer area in a flash tank coil while increasing the flow rate of the oil to the compressor and minimizing the pressure drop of the working fluid throughout the system. Additionally, the refrigeration assembly can keep the superheat stable with proper heat transfer.

DETAILED DESCRIPTION OF THE DISCLOSURE

Oil logging in the suction lines of a refrigeration systems may be common during low-load operating conditions (e.g., during winter months and at night). To reduce or prevent oil logging in the suction lines and to increase the heat transfer area of a receiver tank, a refrigeration assembly with one or more risers and P-traps inside the receiver tank can be implemented.

Figure 1A:
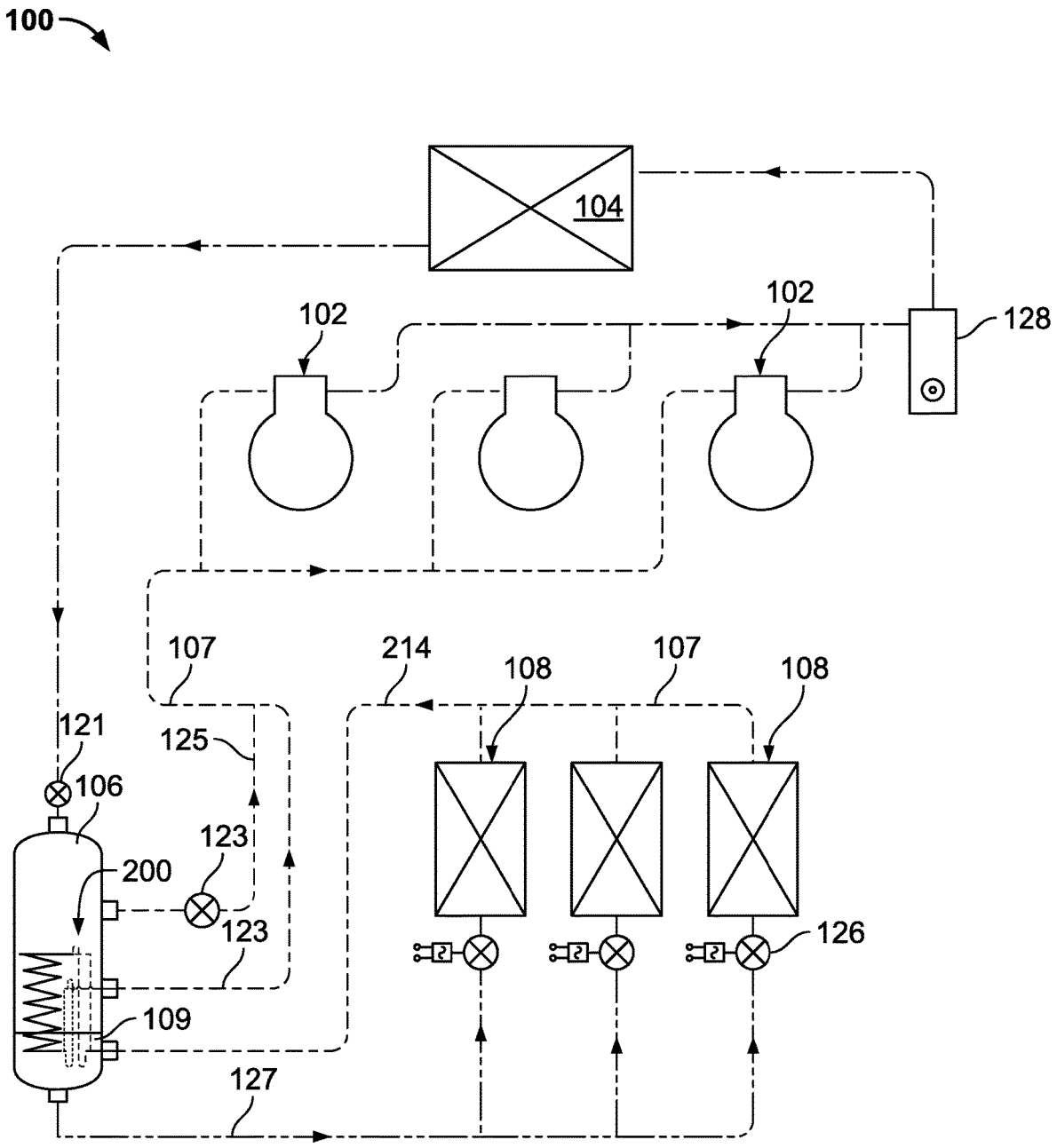
FIG. 1A is a schematic diagram of a refrigeration system according to a first implementation of the present disclosure.

FIG. 1A shows a schematic diagram (e.g., a piping and instrumentation diagram) of a refrigeration system 100. The refrigeration system 100 can be e.g., a basic commercial $CO_2$ refrigeration system, an ammonia refrigeration system, or a chilled water refrigeration system. The refrigeration system 100 includes a compressor 102 or group of compressors (e.g., transcritical compressors, subcritical compressors, or a combination of the two), one or more gas coolers or condensers 104, a receiver tank 106, and an evaporator 108 or group of evaporators (e.g., medium-temperature display cases, low-temperature display cases, or a combination of the two).

In the example of a $CO_2$ refrigeration system, the compressors 102 can flow a medium-temperature discharge working fluid (e.g., $CO_2$) in vapor or gas phase to the gas cooler 104. The gas cooler 104 condenses or cools the medium-temperature working fluid. The vapor or liquid vapor mixture phase of the working fluid flows from the gas cooler 104 to the receiver tank 106. In some implementations, the liquid vapor mixture phase of the working fluid can flow through a valve 121 (e.g., a high-pressure control valve) that lowers the pressure of the liquid vapor mixture phase of the working fluid before it reaches the receiver tank 106.

At the receiver tank 106, the liquid phase of the working fluid (e.g., high-pressure fluid) accumulates at the bottom of the tank 106 and the vapor phase (e.g., medium temperature suction gas) of the working fluid rises to the top of the tank 106. The medium temperature suction gas can be released to the ambient or directed to another component of the refrigeration system 100. For example, the medium temperature suction gas can be conveyed from the receiver tank 106, through a gas line 125, to the compressors 102. The gas line 125 can included a valve 123 (e.g., a flash gas bypass valve) that regulates the pressure of the gas.

The liquid phase of the working fluid flows from the receiver tank 106, through a liquid line 127, to the evaporators 108. The liquid line 127 includes an expansion valve 126 that decreases the pressure of the liquid phase of the working fluid before the working fluid reaches the evaporators 108. The evaporators 108 receive the working fluid (e.g., a liquid vapor mixture of the working fluid) from the expansion valve 126 to transfer heat to the working fluid. The working fluid evaporates in the evaporators 108. The vapor phase of the working fluid flows back from the evaporators 108, through a suction line 107, to the flash tank 106 and then to the compressors 102.

The suction line 107 includes a supply line 214 that supplies the working fluid to the tank 106 and a return line 218 that returns or flows the working fluid from the tank 106 to the compressors 102. As further described in detail below with respect to FIG. 2, the suction line 107 includes or is connected to a heat exchanger 200 disposed inside the receiver tank 106. The working fluid inside the heat exchanger 200 transfers heat through a heat transfer surface 109 of the heat exchanger to the liquid or condensate inside the tank 106. The gas phase of the working fluid flows from the tank 106 to the compressors 102. An oil separator 128 can help convey oil back to the compressors 102, but the oil that escapes the separator can accumulate in the suction lines 107 during low load conditions of the system 100. As further described in detail below with respect to FIG. 2, the heat exchanger 200 inside the tank can help flow oil in the suction lines 107 back to the compressors 102.

Figure 1B:
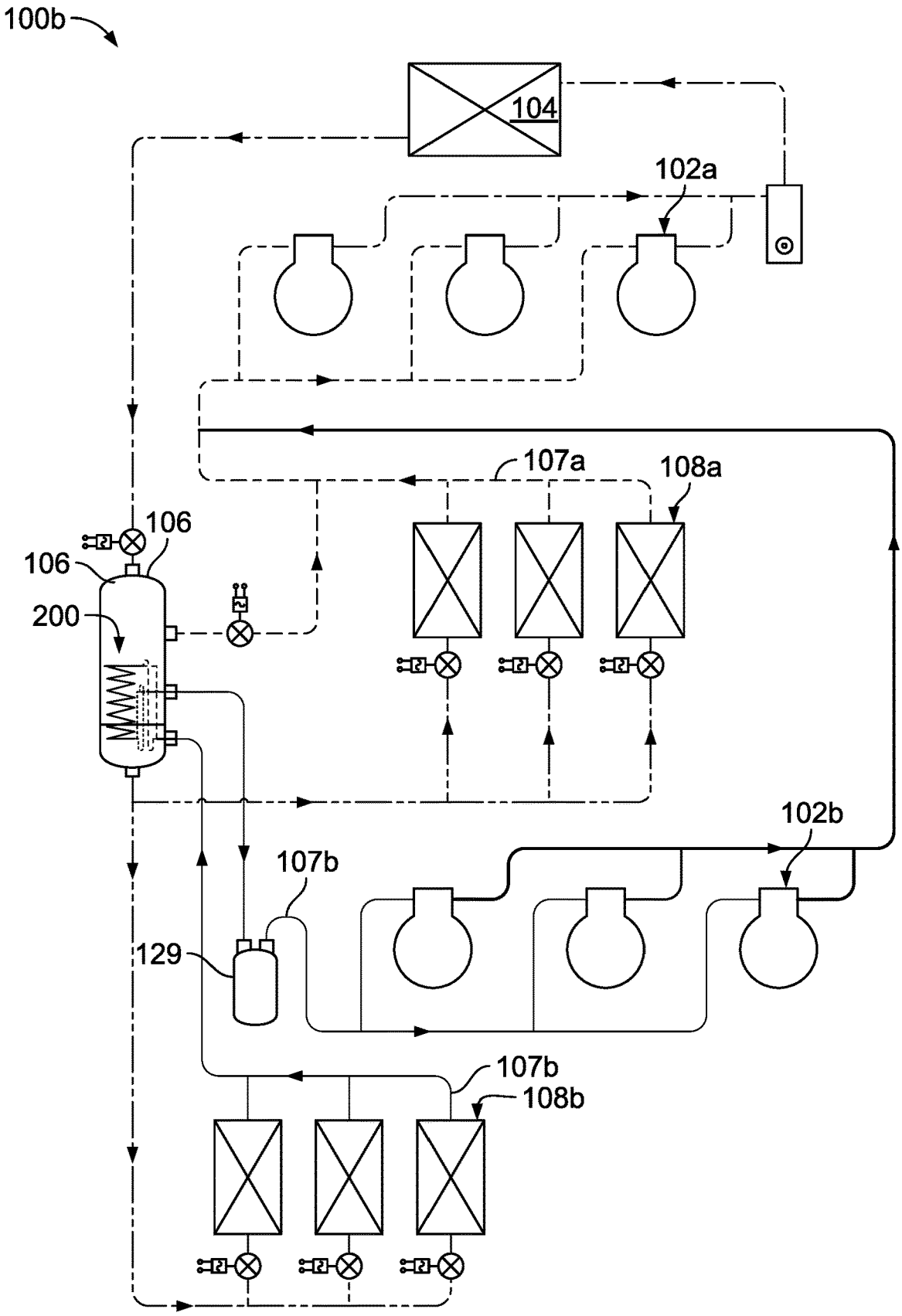
FIG. 1B is a schematic diagram of a refrigeration system according to a second implementation of the present disclosure.

FIG. 1B depicts a refrigeration system 100*b* according to a different implementation of the present disclosure. The refrigeration system 100*b* is similar to the refrigeration system 100 in FIG. 1A, with the exception of separate groups of evaporators and respective compressors. For example, the refrigeration system 100*b* includes one or more medium-temperature evaporators 108*a* (e.g., medium-temperature display cases) and one or more low-temperature evaporators 108*b* (e.g., low-temperature display cases). The medium-temperature evaporators 108*a* can include, for example, refrigerated display cases that display medium-temperature merchandise such as non-frozen products, and the low-temperature display cases 108*b* can include, for example, refrigerated display cases that display low-temperature merchandise such as frozen products.

The refrigeration system 100*b* also includes one or more transcritical compressors 102*a* and one or more subcritical compressors 102*b*. The subcritical compressors 102*b* receive a vapor phase of the working fluid from the low-temperature evaporators 108*b*. The transcritical compressors 102*a* receive a vapor phase of the working fluid from the medium-temperature evaporators 18*a* and from the subcritical compressors 102*b*. The low-temperature suction line 107*b* of the low-temperature evaporators 108*b* is connected to the receiver tank 106.

For example, medium-temperature discharge gas (or liquid and gas) flows from the condenser 104 to the receiver tank 106. A first portion of the liquid phase of the working fluid flows from the tank 106 to the low-temperature evaporators 108*b* (passing first through expansion valves). A second portion of the liquid phase of the working fluid flows from the tank 106 to the medium-temperature evaporators 108*a*. After passing through the low-temperature evaporators 108*b*, the working fluid, as a low-temperature suction gas, flows through the low-temperature suction line 107*b* to the receiver tank 106, and from the tank 106 to the subcritical compressors 102*b*. The suction line 107*b* can include an accumulator 129 that can meter or prevent the flow of fluid refrigerant and oil back to the compressors 102*b*. The working fluid, as a low-temperature discharge gas, flows from the subcritical compressors 102*b* to mix with the medium temperature suction gas that flows from the medium-temperature evaporators 108*a* to the transcritical compressors 102*a*. The medium temperature suction gas flows through a medium temperature suction line 107*a* to the transcritical compressors 102*a*.

Figure 1C:
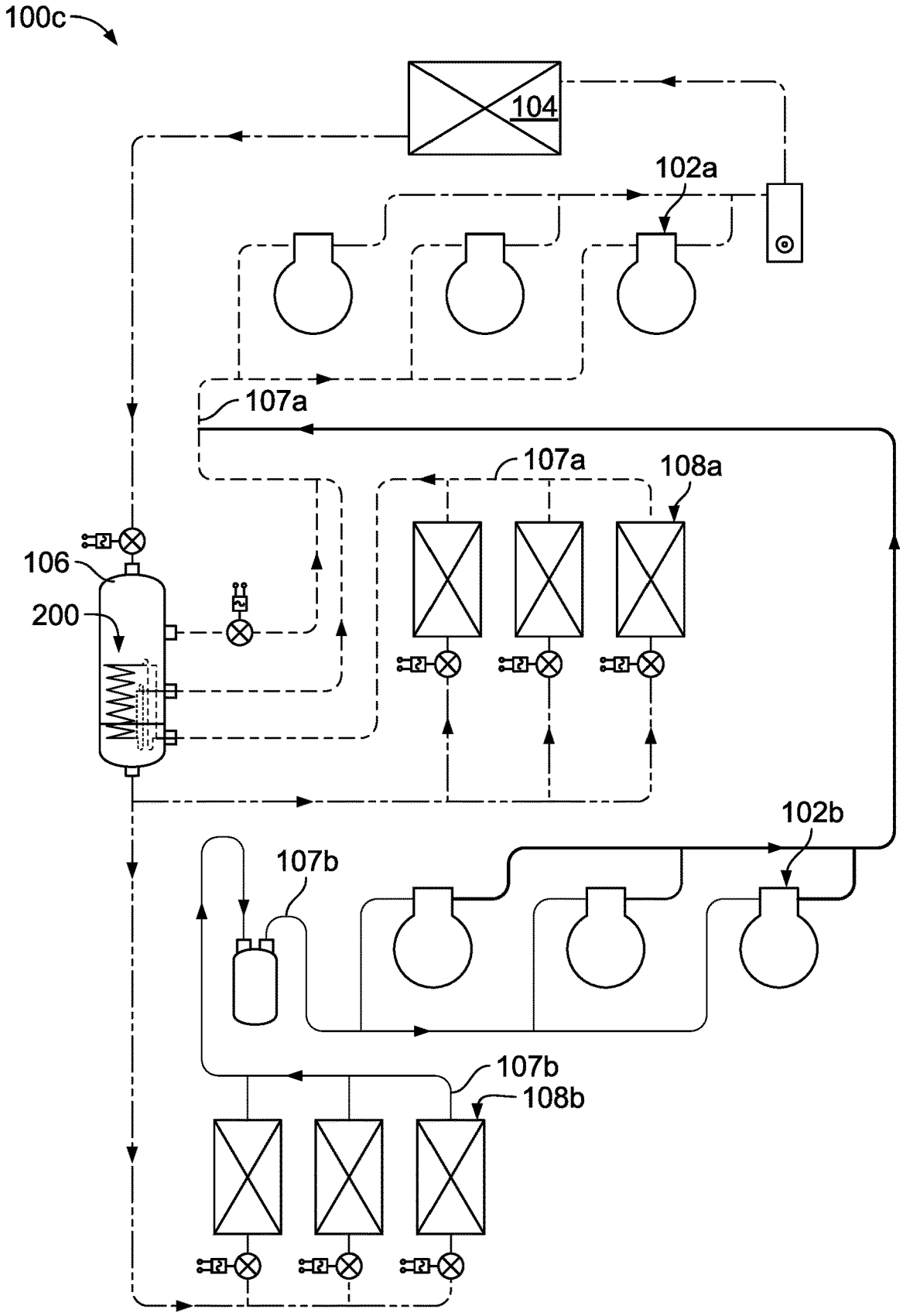
FIG. 1C is a schematic diagram of a refrigeration system according to a third implementation of the present disclosure.

FIG. 1C depicts a refrigeration system 100*c* similar to the refrigeration system 100*b* in FIG. 1B, with the exception of the medium-temperature suction line 107*a* of the medium-temperature evaporators 108*a* being connected to the receiver tank 106. For example, the low-temperature suction line 107*b* extends from the low-temperature evaporators 108*b* to the subcritical compressors 102*b* without passing through the receiver tank 106. The medium-temperature suction line 107*a* includes the heat exchanger 200 inside the tank 106.

Figure 1D:
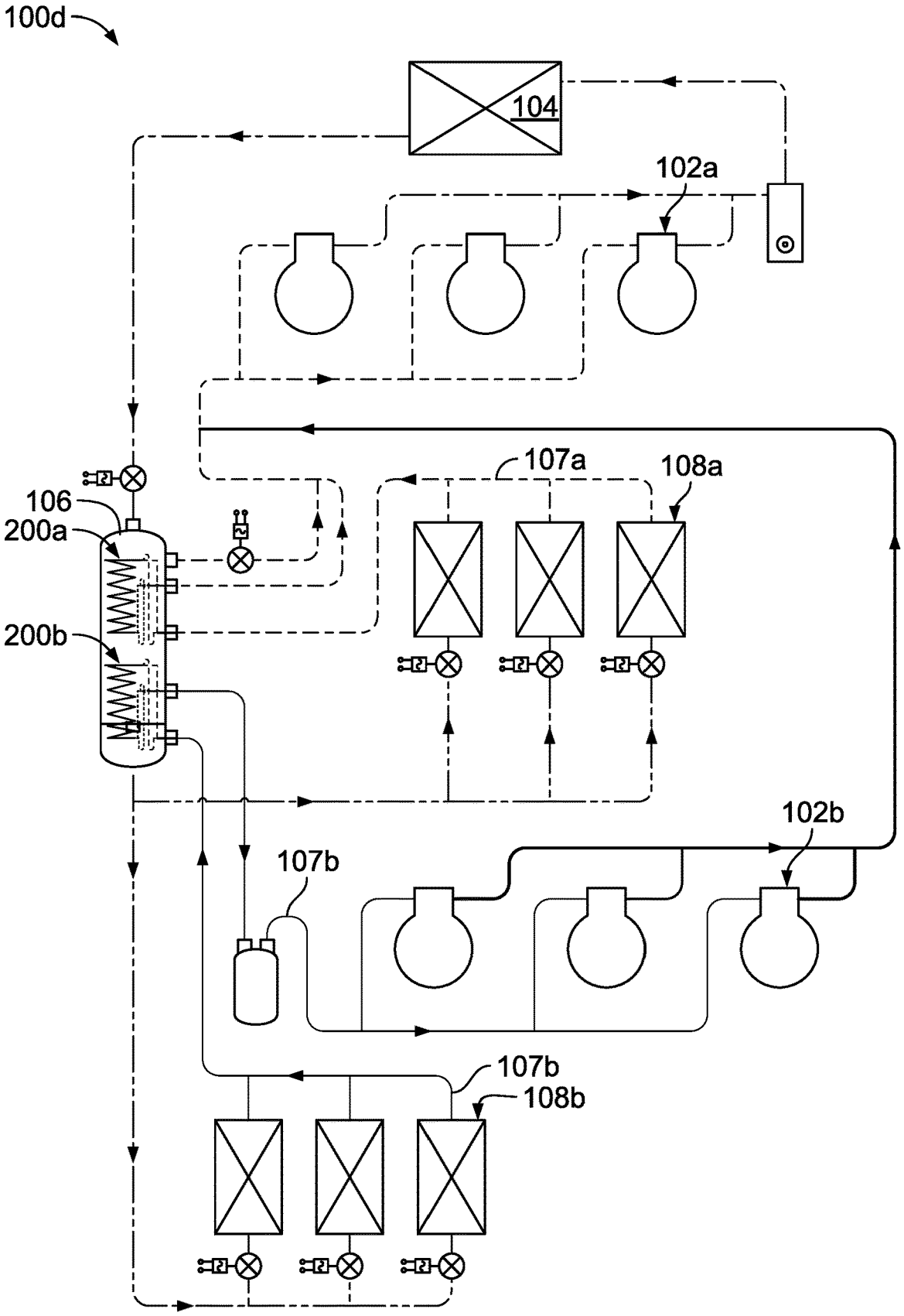
FIG. 1D is a schematic diagram of a refrigeration system according to a fourth implementation of the present disclosure.

FIG. 1D depicts a refrigeration system 100*d* similar to the refrigeration systems 100*b* and 100*c* in FIGS. 1B and 1C respectively, with the exception of having both suction lines 107*a* and 107*b* connected to the receiver tank 106. The medium-temperature suction line 107*a* is connected to a first heat exchanger 200*a* disposed inside the receiver tank 106. The low-temperature suction line 107*b* is connected to a second heat exchanger 200*b* disposed inside the receiver tank 106. Both heat exchangers 200*a* and 200*b* can transfer heat to the working fluid inside the receiver tank 106.

Figure 2:
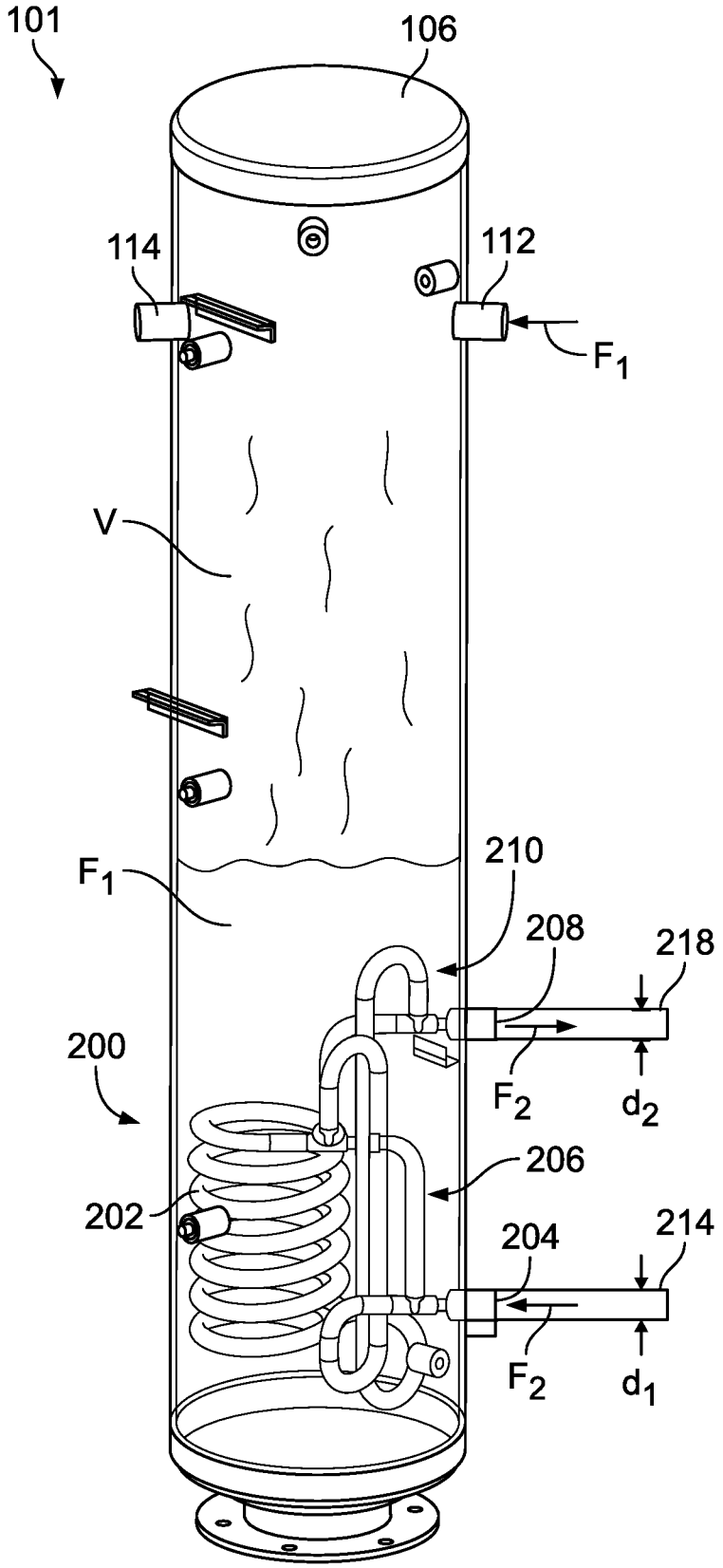
FIG. 2 is a perspective view of a refrigeration assembly according to implementations of the present disclosure.

FIG. 2 depicts a refrigeration assembly 101 according to implementations of the present disclosure. The refrigeration assembly 101 includes the receiver tank 106 (e.g., a receiver flash tank or vessel or liquid vapor separator) and a heat exchanger 200 (e.g., a heat exchanger coil) disposed within the receiver flash tank 106. The flash tank 106 defines an interior volume "V" that retains or stores a first working fluid "F1" (e.g., high-pressure condensate). The first working fluid (liquid or liquid vapor mixture) is received into the receiver tank 106 through a fluid inlet port 112. The first working fluid (liquid or liquid vapor mixture) exits the receiver tank 106 through a fluid outlet port 114. The first working fluid "F1" can include a liquid-vapor mixture, with the liquid stored at the bottom of the receiver tank 106 to contact the heat exchanger 200.

The heat exchanger 200 is in thermal communication (e.g., thermal contact) with the first working fluid "$F_1$." For example, the heat exchange 200 is in thermal communication with the liquid within the tank 106. The heat exchanger 200 transfers heat from a second working fluid "$F_2$" to the first working fluid "$F_1$," and vice versa. For example, as the second working fluid "$F_2$" flows along the piping of the heat exchanger 200, at least a portion of the first fluid "$F_1$" can condense and flow down as liquid. In some implementations, the fluid "$F_2$" can sub cool the fluid "$F_1$" and portion of the vapor phase of the fluid "$F_1$."

The heat exchanger 200 includes coiled tubing 202, a fluid inlet 204 fluidly coupled to the coiled tubing 202, and a fluid outlet 208 fluidly coupled to the coiled tubing 202. For example, the fluid inlet 204 is fluidly coupled with the coiled tubing 202 by being arranged to communicate the second working fluid "$F_2$" to the coiled tubing 202. Likewise, the fluid outlet 208 is arranged to receive the second working fluid "$F_2$" from the coiled tubing 202. The heat exchanger 200 also includes a first piping assembly 206 that resides between and that is fluidly coupled to the fluid inlet 204 and the coiled tubing 202.

The second working fluid "$F_2$" can include a refrigerant (e.g., $CO_2$, ammonia, R134a, water, or a combination of the four) and oil from the compressor. During low-load conditions of the system, the oil may log in the heat exchanger 200. As further described in detail below with respect to FIG. 3, the piping assembly 206 helps flow accumulated or logged oil back to the compressor by implementing a double riser configuration that increases the velocity of the second working fluid during low-load conditions. Because the first piping assembly 206 is disposed inside the flash tank 106, the first piping assembly 206 is in thermal contact with the liquid or vapor or liquid vapor mixture phase of the first working fluid "$F_1$" inside the tank 106. Such configuration increases the heat transfer area of the piping assembly 206 inside the tank 106. By increasing the heat transfer area inside the tank 106, the heat transferred between the second fluid and the first fluid can be incremented, increasing the efficiency of the refrigeration cycle.

The heat exchanger 200 can also include a second piping assembly 210 that resides between and that is fluidly coupled to the fluid outlet 208 and the coiled tubing 202. The second piping assembly 210 helps flow accumulated oil back to the compressor by increasing the velocity of the second fluid "$F_2$." Because the second piping assembly 210 is disposed inside the flash tank 106, the second piping assembly 210 is in thermal contact with the liquid or vapor or liquid vapor mixture phase of the first working fluid "$F_1$" inside the tank 106. Such configuration further increases the heat transfer area of the piping assembly 206 inside the tank 106. The first and second piping assemblies 206 and 210 increase the heat transfer surface or area of the heat exchanger 200 to more effectively transfer heat to and from the first working fluid "$F_1$."

For example, the temperature in a superheat state of the working fluid "$F_2$" at the inlet 204 may not be stable and varies due to display case operating conditions (low super heat in most cases), which can damage the compressors. The heat transfer between the working fluids "$F_1$" and "$F_2$" inside the tank helps to maintain stable temperature/superheat at the outlet 208 of the fluid $F_2$.

The two piping assemblies 206 and 210 can be different from each other. For example, the working fluid can enter the heat exchanger 200 through the inlet 204 at the bottom and the fluid flows up through the inlet double riser to enter the coil tubing 202 at the top. The working fluid flows downward through the coil tubing 202 and to the outlet double riser. The two double risers can be designed such that the working fluid is generally always flowing through the coil 202 so that the full heat transfer takes place. The two double risers can increase the velocity at both the inlet 204 and the outlet 208 to carry the oil back to the compressors during low-load conditions.

The fluid inlet 204 of the receiver tank 106 is attached to and is in fluid communication with supply suction line 214. The supply suction line 214 extends from the outlet of an evaporator or display cases or coolers or freezers to the receiver tank 106. The fluid outlet 208 of the receiver tank 106 is attached to and in fluid communication with a return suction line 218. For example, the return suction line 218 directs the second working fluid "$F_2$" received from the outlet 208 of the receiver tank 106 to compressor(s).

In some implementations, the suction lines 214 and 218 can be sized to maintain the second working fluid "$F_2$" flowing at a desired velocity to achieve the desired flow rate of the oil back to the compressor. In some implementations, the first and second piping assemblies 206 and 210 can flow accumulated fluid/gas back to the compressor while minimizing a pressure drop across the heat exchanger 200, which allows the suction pipes 214 and 218 to have equal or similar sizes. For example, the supply suction line 214 has a first diameter (e.g., internal diameter) "$d_1$" and the suction line 218 can have a second diameter (e.g., internal diameter) "$d_2$" that is different or substantially equal to the first diameter "$d_1$."

In some implementations, the receiver tank 106 can be a flash tank of a $CO_2$ refrigeration assembly. For example, the second working fluid "$F_2$" flown in the heat exchanger coil 200 can include $CO_2$ vapor and the first working fluid "$F_1$" in thermal contact with the heat exchanger coil 200 can include $CO_2$ in liquid or liquid vapor mixture phase.

Figure 4:
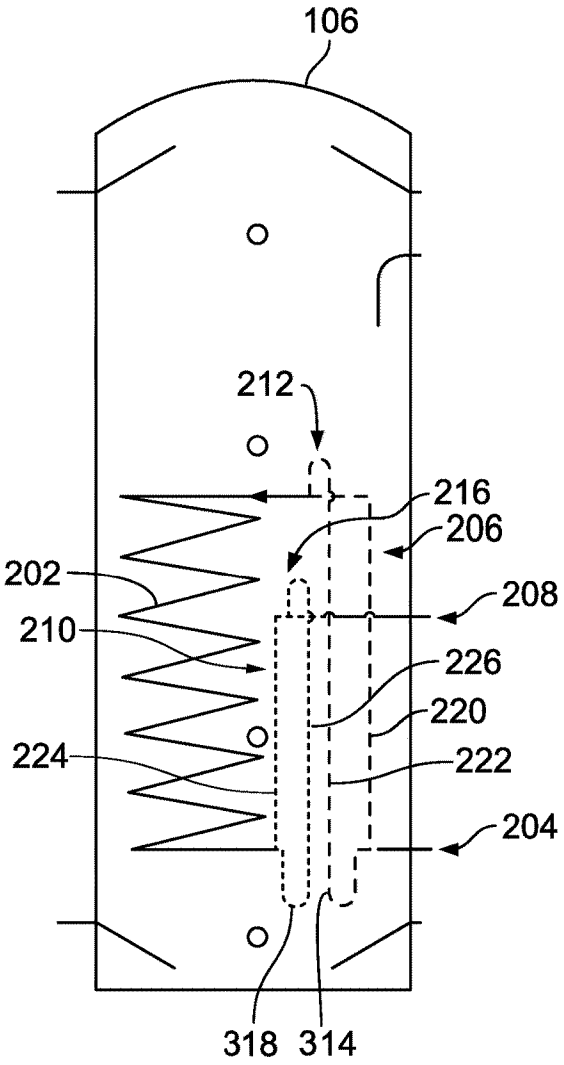
FIG. 4 is a schematic diagram of the refrigeration assembly in FIG. 1.
Figure 3:
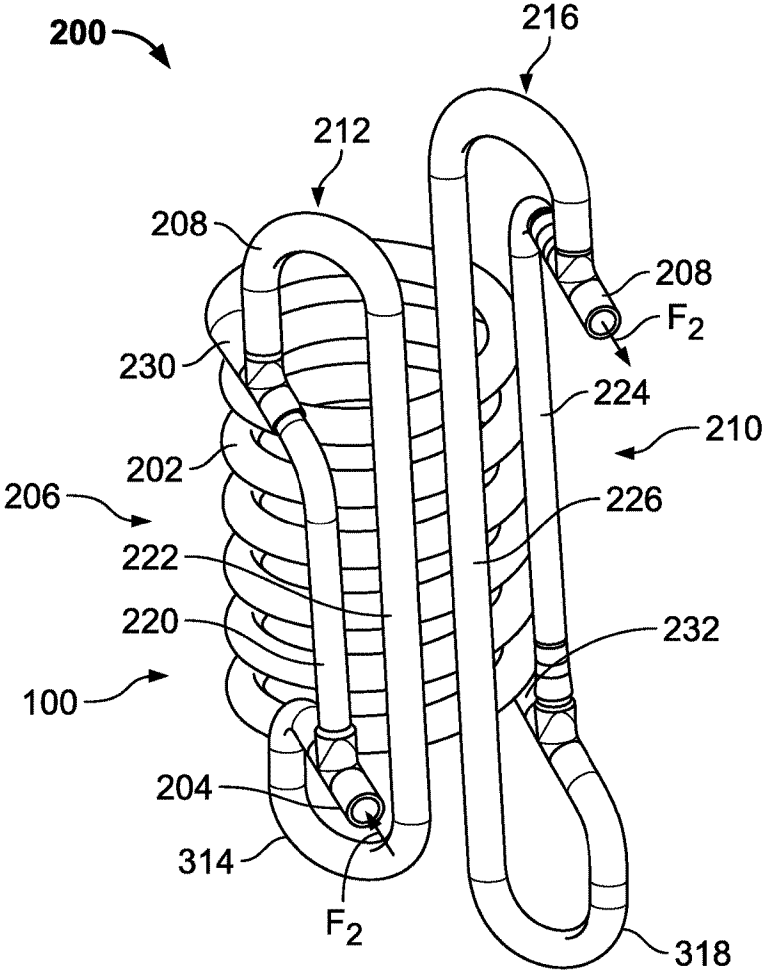
FIG. 3 is a perspective view of a heat exchanger of the refrigeration assembly in FIG. 1.

FIGS. 3 and 4 show the configuration of the two piping assemblies 206 and 210 that are disposed inside the receiver tank 106. In some implementations, the heat exchanger 200 can only include one piping assembly 206. The two piping assemblies 206 and 210 together help flow accumulated oil back to the compressor. For example, as depicted in FIG. 3, the first piping assembly 206 can include a first double riser 212 and a first P-trap or oil trap 314. The first piping assembly 206 resides between and is in fluid communication with the fluid inlet 204 and the coiled tubing 202. The second piping assembly 210 can include a second double riser 216 and a second P-trap or oil trap 318. The second piping assembly 210 resides between and is in fluid communication with the fluid outlet 208 and the coiled tubing 202.

The working fluid "$F_2$" may include a mixture of refrigerant and oil that, during low-load conditions, may leave behind the oil which then accumulates along the tubing (e.g., due to the relatively low velocity of the refrigerant). The refrigeration system 100 can be considered to run at low-load conditions when the system operates at about 5% to 20% of the total load capacity. For example, if the refrigeration system 100 is designed to remove the heat load of 100,000 BTUs per hour (BTUH), then from about 5,000 BTUH to 20,000 BTUH is considered as low load. During this time, not all compressors will run but one compressor may run at low speed. The first P-trap 314 and the second P-trap 318 retain oil as the refrigerant flows through the heat exchanger 200 during low-load conditions. For example, the first P-trap 314 can retain oil received from the fluid inlet 204, and the second P-trap 318 can retain oil received from the coiled tubing 202.

The coiled tubing 202 has a first end 230 attached to the first double riser 212 and a second end 232 attached to the second double riser 216. The first end 230 is positioned vertically above the second end 232. For example, the first end 230 is arranged at a first elevation and the second end 232 is arranged at a second elevation lower than the first elevation.

Each of the first and second double risers 212 and 216 can include a main riser (e.g., a first riser) and a secondary riser (e.g., a second riser). In some implementations, the main riser can be smaller than the secondary riser. For example, the first double riser 212 includes a first riser 220 and a second riser 222. The second riser 222 can include the first P-trap 314. The first riser 220 is attached to and in fluid communication with the second riser 222. The second double riser 216 includes a third riser 224 and a fourth riser 226. The fourth riser 226 can include the second P-trap 318. The third riser 224 is attached to and in fluid communication with the fourth riser 226.

The first riser 220 can have a first inner diameter and the second riser 222 can have a second inner diameter larger than the first inner diameter. Similarly, the third riser 224 can have a third inner diameter and the fourth riser 226 can have a fourth inner diameter larger than the third inner diameter. For example, the first riser 220 can have a diameter of about ⅜ inch to 2⅛ inches, and the second riser 222 can have a diameter of about ½ inch to 2⅝ inches. Similarly, the third riser 224 can have an inner diameter of about ⅜ inch to 2⅛ inches, and the fourth riser 226 can have an inner diameter of about ½ inch to 2⅝ inches. The size (e.g., inner diameters) of the double risers and the coiled tubing 202 can be oversized to use uniform sizes (e.g., reduce the changes in sizing) across the heat exchanger 200. The size of the heat exchanger can be designed to keep, for example, during normal load conditions, the velocity of the second fluid "$F_2$" at about 1200 feet per minute to return the oil to the compressor.

During full load or normal load conditions, the refrigerant and oil mixture enters the inlet 204 and most or all of the fluid/gas and oil mixture flows through the first P-trap 314, up the second riser 222, and then through the first double riser 212. In some implementations, part of the fluid/gas and oil mixture can flow through the first riser 220 and then enter the coil tubing 202 at the inlet 230 of the coil tubing 202. The mixture flows downwards through the coil tubing 202 and exits the coil tubing 202 through the outlet 232 of the coil tubing 202. Then, most or all of the fluid/gas and oil mixture flows through the second P-trap 318, up the fourth riser 226, and through the second double riser 216. A part of the fluid/gas and oil mixture flows through the third riser 224 and exits at the outlet 208.

During partial/low load condition, the fluid/gas and oil mixture enters through the inlet 204 and flows to the first P-trap 314. Due to the low velocity of the mixture, oil accumulates at the P-trap 314 and blocks the gas flow through the first P-trap 314, which forces the mixture to flow through the first riser 220. Because the first riser 220 is smaller in diameter when compared to 222, the mixture increases in velocity through the first riser 220, thereby carrying the oil to the compressor(s). Similarly, when the mixture enters the second P-trap 318, oil accumulates in the P-trap 318 and blocks the flow of mixture through the fourth riser 226. The blockage forces the mixture to flow through the third riser 224 to exit through the fluid outlet 208. Because the third riser 224 has a smaller diameter compared to the fourth riser 226, the mixture increases in velocity and carries the oil to the compressor(s).

In some implementations, when the load increases, the pressure of the mixture is high enough to push the oil from the P-traps 314 and 318 up the large risers 222 and 226. In some implementations, when the load increases, the piping assemblies 206 and 210 can create a pressure differential to drag or suck the oil up the large risers 222 and 226 until the larger pipe is unclogged, which allows the system to working normally again.

Figure 5:
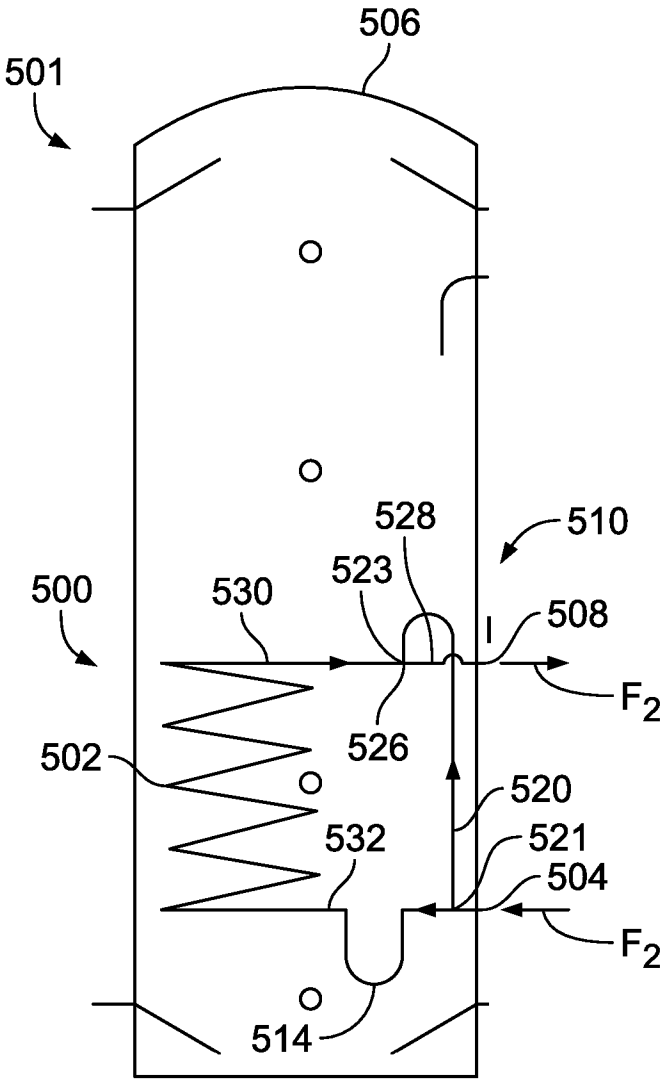
FIG. 5 is a schematic diagram of a refrigeration assembly according to a second implementation of the present disclosure.

FIG. 5 shows a piping diagram of a refrigeration assembly 501 according to a second implementation of the present disclosure. The refrigeration assembly 501 includes a receiver tank 506 and a heat exchanger 500 disposed inside the receiver tank 506. The refrigeration assembly 501 can be similar to the refrigeration assembly 101 in FIGS. 2-4, with the exception of the heat exchanger 500 including one riser 220 and one P-trap 514. For example, the heat exchanger 500 includes a coiled tubing 502 and a piping assembly 510 disposed inside the tank 506. The piping assembly 510 includes a single riser 520 and an oil trap 514 fluidly coupled to the riser 520. The heat exchanger 500 includes a fluid inlet 504 and a fluid outlet 508. The fluid inlet 504 receives the second working fluid "$F_2$" from the supply suction line and the fluid outlet 508 flows the second working fluid "$F_2$" received from coiled tubing out of the flash tank 506 to the return suction line.

The P-trap 514 resides between and is in fluid communication with the fluid inlet 504 and the coiled tubing 502. The P-trap 514 is disposed downstream of an inlet 521 of the riser 520. The riser extends from the inlet 521 of the riser 520 to an outlet 523 of the riser 520. The riser 520 is attached, through a fluid connection 526 at the outlet 523 of the riser, to a pipe 528 connected to and disposed between the fluid outlet 508 of and the coiled piping 502 of the heat exchanger 500.

The single riser 520 and P-trap 514 together help flow oil back to the compressor. For example, during a low load condition, oil accumulates in the P-trap 514 and blocks the flow, which forces the fluid/gas and oil mixture through the secondary riser 520. During a full load condition, most of the fluid/gas and oil mixture flows through the coil 502 and part of the fluid/gas & oil mixture through the riser 520.

The coiled tubing 500 has a first end 530 attached to the fluid outlet 508 and a second end 532 attached to the fluid inlet 504. The first end 530 resides at a first elevation and the second end 532 resides at a second elevation lower than the first elevation.

Figure 6:
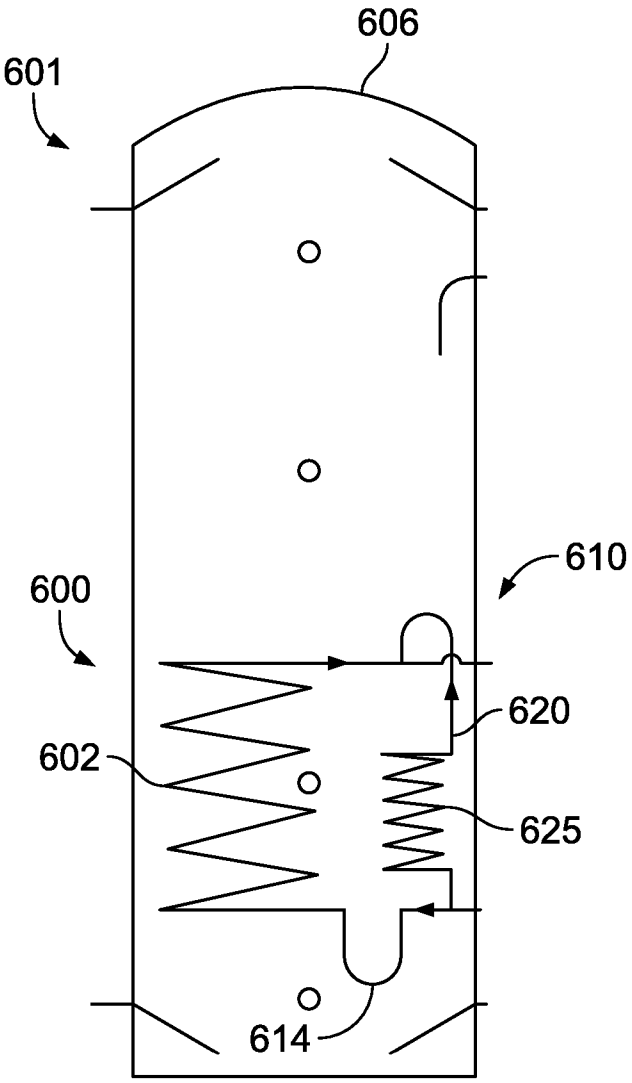
FIG. 6 is a schematic diagram of a refrigeration assembly according to a third implementation of the present disclosure.

FIG. 6 shows a piping diagram of a refrigeration assembly 601 according to a third implementation of the present disclosure. The refrigeration assembly 601 includes a receiver tank 606 and a heat exchanger 600 disposed inside the receiver tank 606. The refrigeration assembly 601 can be similar to the refrigeration assembly 101 in FIG. 5, with the exception of the heat exchanger 600 includes one riser 620 with coiled tubing 625 (e.g., a second coiled). The heat exchanger includes a main coiled tubing 602 and a piping assembly 610 in fluid communication with the main coiled tubing 602. The piping assembly 610 includes a single riser 620 and a P-trap 614. The single riser 620 has a second coiled tubing 625 in thermal communication with the liquid inside the flash tank 606.

As described above with respect to FIG. 1D, each refrigeration assembly 101, 501, and 601 can be designed with two set of heat exchangers 200, 500, and 600 inside the same tank 106, 506 and 606 respectively to accommodate dual suction group refrigeration systems.

Although the following detailed description contains many specific details for purposes of illustration, it is understood that one of ordinary skill in the art will appreciate that many examples, variations and alterations to the following details are within the scope and spirit of the disclosure. Accordingly, the exemplary implementations described in the present disclosure and provided in the appended figures are set forth without any loss of generality, and without imposing limitations on the claimed implementations.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The singular forms "a", "an" and "the" include plural referents, unless the context clearly dictates otherwise.

As used herein, the terms "aligned," "substantially aligned," "parallel," or "substantially parallel" refer to a relation between two elements (e.g., lines, axes, planes, surfaces, or components) as being oriented generally along the same direction within acceptable engineering, machining, drawing measurement, or part size tolerances such that the elements do not intersect or intersect at a minimal angle. For example, two surfaces can be considered aligned with each other if surfaces extend along the same general direction of a device or component.

As used in the present disclosure and in the appended claims, the words "comprise," "has," and "include" and all grammatical variations thereof are each intended to have an open, non-limiting meaning that does not exclude additional elements or steps.

As used in the present disclosure, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that that the mere use of the term "first" and "second" does not require that there be any "third" component, although that possibility is contemplated under the scope of the present disclosure.

What is claimed is:

1. A refrigeration assembly comprising:

a receiver tank comprising:

an interior volume configured to enclose a first working fluid;

an inlet port configured to conduct the first working fluid into the interior volume; and an outlet port configured to conduct the first working fluid out of the interior volume;

a heat exchanger disposed within the receiver tank, the heat exchanger configured to direct a second working fluid through the receiver tank, the heat exchanger comprising:

a coiled tubing configured to fluidly decouple the second working fluid from the first working fluid in the interior volume, the coiled tubing comprising a first end and a second end;

a fluid inlet configured to couple to and receive the second working fluid from a supply line;

a first piping assembly disposed within the receiver tank, the first piping assembly positioned between the fluid inlet and the first end of the coiled tubing, the first piping assembly comprising a first double riser and a first P-trap, the first double riser comprising:

a first riser fluidly coupled to the fluid inlet and the first end of the coiled tubing, the first riser configured to flow the second working fluid from the fluid inlet to the first end of the coiled tubing; and a second riser fluidly coupled to the fluid inlet and the first end of the coiled tubing by the first P-trap, the second riser downstream of the first P-trap, the second riser configured to flow the second working fluid from the fluid inlet to the first end of the coiled tubing;

a fluid outlet configured to couple to and conduct the second working fluid to a return line; and a second piping assembly disposed within the receiver tank, the second piping assembly positioned between the fluid outlet and the second end of the coiled tubing, the second piping assembly comprising a second double riser and a second P-trap, the second double riser comprising:

a third riser fluidly coupled to the second end of the coiled tubing and the fluid outlet, the third riser configured to flow the second working fluid from the second end of the coiled tubing to the fluid outlet; and a fourth riser fluidly coupled to the second end of the coiled tubing and the fluid outlet by the second P-trap, the fourth riser downstream of the second P-trap, the fourth riser configured to flow the second working fluid from the second end of the coiled tubing to the fluid outlet.

2. The refrigeration assembly of claim 1, wherein the first P-trap is configured to retain oil received from the fluid inlet during a low-load condition of the refrigeration assembly, and the second P-trap is configured to retain oil received from the coiled tubing during the low-load condition of the refrigeration assembly.

3. The refrigeration assembly of claim 1, wherein the supply line comprises a first diameter and the return line comprises a second diameter different than the first diameter.

4. The refrigeration assembly of claim 1, wherein the first riser and the third riser each comprise a first diameter and the second riser and the fourth riser each comprise a second diameter larger than the first diameter.

5. The refrigeration assembly of claim 1, where the first piping assembly and the second piping assembly are in thermal contact with the first working fluid inside the receiver tank such that the second working fluid flowing through the first piping assembly and the second piping assembly transfers heat to a liquid phase of the first working fluid inside the receiver tank or the liquid phase of the first working fluid inside the receiver tank transfers heat to the first piping assembly and the second piping assembly.

6. The refrigeration assembly of claim 1, wherein the heat exchanger is a first heat exchanger, the refrigeration assembly further comprises:

a set of low-temperature evaporators;

a set of subcritical compressors;

a second heat exchanger disposed within the receiver tank, the second heat exchanger configured to direct the second working fluid through the receiver tank from the set of low-temperature evaporators to the set of subcritical compressors, the second heat exchanger comprising a second coiled tubing;

a third piping assembly comprising a third piping assembly-fluid inlet and a third piping assembly-fluid outlet, the third piping assembly disposed within the receiver tank, the third piping assembly between and fluidly coupled to a second supply line and the second coiled tubing, the third piping assembly comprising a third double riser and a third P-trap; and a fourth piping assembly comprising a fourth piping assembly-fluid inlet and a fourth piping assembly-fluid outlet, the fourth piping assembly disposed within the receiver tank, the fourth piping assembly between and fluidly coupled to a second return line and the second coiled tubing, the fourth piping assembly comprising a fourth double riser and a fourth P-trap.

7. The refrigeration assembly of claim 1, wherein the first riser and the third riser each comprise a first inner diameter and the second riser and the fourth riser each comprise a second inner diameter, the second inner diameters larger than the first inner diameters such that during a normal or greater than normal load condition:

a portion of the second working fluid flows through fluid inlet into the first P-trap, then through the coiled tubing to the second riser and out the fluid outlet;

simultaneously, a remaining portion of the second working fluid flows through the first riser to the coiled tubing, the remaining portion rejoining the portion at the first end of the coiled tubing;

the second working fluid flows through the coiled tubing into the second piping assembly; and the second working fluid flows through the second piping assembly such that:

a portion of the second working fluid flows into the second P-trap, then through the fourth riser to the fluid outlet to the return line; and simultaneously, a remaining portion of the second working fluid flows through the third riser to the fluid outlet and into the return line.

8. The refrigeration assembly of claim 7, wherein during a low load condition, the low load condition less than the normal load condition:

a portion of the second working fluid flows through the fluid inlet into the first P-trap and due to a low velocity of the second working fluid in the low load condition lower than a normal velocity of the second working fluid during the normal load condition, an oil portion of the second working fluid accumulates at the first P-trap and blocks a gas portion of the second working fluid from flowing through the first P-trap, forcing a remaining portion of the second working fluid to flow from the fluid inlet into the first riser to the coiled tubing; and a velocity of the remaining portion in the first riser increases responsive to the first P-trap being blocked, carrying an oil portion of the remaining portion of the second working fluid to the coiled tubing;

the second working fluid flows through the coiled tubing into the second piping assembly; and the second working fluid flows through the second piping assembly such that:

a portion of the second working fluid flows through the second end of the coiled tubing into the second P-trap and due to a low velocity of the second working fluid in the low load condition lower than a normal velocity of the second working fluid during the normal load condition, an oil portion of the second working fluid accumulates at the second P-trap and blocks a gas portion of the second working fluid from flowing through the second P-trap, forcing a remaining portion of the second working fluid to flow from the second end of the coiled tubing into the third riser to the fluid outlet; and a velocity of the remaining portion in the third riser increases responsive to the second P-trap being blocked, carrying an oil portion of the remaining portion of the second working fluid to the return line.

9. The refrigeration assembly of claim 1, wherein the second working fluid comprises a mixture of refrigerant and oil, and the first P-trap and the second P-trap are configured to retain oil accumulated during flowing of the second working fluid through the refrigeration assembly.

10. The refrigeration assembly of claim 9, wherein each of the first piping assembly and the second piping assembly are configured to flow, during different load conditions of the refrigeration assembly, the oil from the respective P-traps toward the return line.

11. The refrigeration assembly of claim 9, wherein the first end of the coiled tubing resides at a first elevation and the second end of the coiled tubing resides at a second elevation lower than the first elevation.

12. The refrigeration assembly of claim 11, wherein the first double riser is configured to flow oil received from the first P-trap to the coiled tubing, the second P-trap is configured to receive oil from the coiled tubing, and the second double riser is configured to flow oil received from the second P-trap to the return line.

13. The refrigeration assembly of claim 11, wherein the refrigeration assembly is configured to operate under a first load condition and a second load condition higher than the first load condition, the first riser of the first double riser is configured to increase a flow speed of the second working fluid with the first P-trap substantially blocked by accumulated oil during the first load condition, and the third riser of the second double riser is configured to increase a flow speed of the second working fluid with the second P-trap substantially blocked by accumulated oil during the first load condition.

14. The refrigeration assembly of claim 9, wherein the first P-trap is configured to retain oil received from the fluid inlet during a low-load condition of the refrigeration assembly, and the second P-trap is configured to retain oil received from the coiled tubing during the low-load condition of the refrigeration assembly.

15. The refrigeration assembly of claim 9, wherein the supply line comprises a first diameter and the return line comprises a second diameter different than the first diameter.

16. The refrigeration assembly of claim 9, wherein the first riser and the third riser each comprise a first diameter and the second riser and the fourth riser each comprise a second diameter larger than the first diameter.

17. The refrigeration assembly of claim 9, where the first piping assembly and the second piping assembly are in thermal contact with the first working fluid inside the receiver tank such that the second working fluid flowing through the first piping assembly and the second piping assembly transfers heat to a liquid phase of the first working fluid inside the receiver tank or the liquid phase of the first working fluid inside the receiver tank transfers heat to the first piping assembly and the second piping assembly.

18. The refrigeration assembly of claim 9, wherein the heat exchanger is a first heat exchanger, the refrigeration assembly further comprises:

a set of low-temperature evaporators;

a set of subcritical compressors;

a second heat exchanger disposed within the receiver tank, the second heat exchanger configured to direct the second working fluid through the receiver tank from the set of low-temperature evaporators to the set of subcritical compressors, the second heat exchanger comprising a second coiled tubing;

a third piping assembly comprising a third piping assembly-fluid inlet and a third piping assembly-fluid outlet, the third piping assembly disposed within the receiver tank, the third piping assembly between and fluidly coupled to a second supply line and the second coiled tubing, the third piping assembly comprising a third double riser and a third P-trap; and a fourth piping assembly comprising a fourth piping assembly-fluid inlet and a fourth piping assembly-fluid outlet, the fourth piping assembly disposed within the receiver tank, the fourth piping assembly between and fluidly coupled to a second return line and the second coiled tubing, the fourth piping assembly comprising a fourth double riser and a fourth P-trap.

19. The refrigeration assembly of claim 9, wherein the first riser and the third riser each comprise a first inner diameter and the second riser and the fourth riser each comprise a second inner diameter, the second inner diameters larger than the first inner diameters such that during a normal or greater than normal load condition:

a portion of the second working fluid flows through fluid inlet into the first P-trap, then through the coiled tubing to the second riser and out the fluid outlet;

simultaneously, a remaining portion of the second working fluid flows through the first riser to the coiled tubing, the remaining portion rejoining the portion at the first end of the coiled tubing;

the second working fluid flows through the coiled tubing into the second piping assembly; and the second working fluid flows through the second piping assembly such that:

a portion of the second working fluid flows into the second P-trap, then through the fourth riser to the fluid outlet to the return line; and simultaneously, a remaining portion of the second working fluid flows through the third riser to the fluid outlet and into the return line.

20. The refrigeration assembly of claim 19, wherein during a low load condition, the low load condition less than the normal load condition:

a portion of the second working fluid flows through the fluid inlet into the first P-trap and due to a low velocity of the second working fluid in the low load condition lower than a normal velocity of the second working fluid during the normal load condition, an oil portion of the second working fluid accumulates at the first P-trap and blocks a gas portion of the second working fluid from flowing through the first P-trap, forcing a remaining portion of the second working fluid to flow from the fluid inlet into the first riser to the coiled tubing; and a velocity of the remaining portion in the first riser increases responsive to the first P-trap being blocked, carrying an oil portion of the remaining portion of the second working fluid to the coiled tubing;

the second working fluid flows through the coiled tubing into the second piping assembly; and the second working fluid flows through the second piping assembly such that:

a portion of the second working fluid flows through the second end of the coiled tubing into the second P-trap and due to a low velocity of the second working fluid in the low load condition lower than a normal velocity of the second working fluid during the normal load condition, an oil portion of the second working fluid accumulates at the second P-trap and blocks a gas portion of the second working fluid from flowing through the second P-trap, forcing a remaining portion of the second working fluid to flow from the second end of the coiled tubing into the third riser to the fluid outlet; and a velocity of the remaining portion in the third riser increases responsive to the second P-trap being blocked, carrying an oil portion of the remaining portion of the second working fluid to the return line.

* * * * *